US006958579B2

(12) United States Patent
Sokoly et al.

(10) Patent No.: US 6,958,579 B2
(45) Date of Patent: Oct. 25, 2005

(54) THERMALLY-PROTECTED BALLAST FOR HIGH-INTENSITY-DISCHARGE LAMPS

(75) Inventors: Theodore O. Sokoly, Franklin, WI (US); Wayne P. Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 26 days.

(21) Appl. No.: 10/214,225

(22) Filed: Aug. 7, 2002

(65) Prior Publication Data

US 2004/0032219 A1 Feb. 19, 2004

(51) Int. Cl.[7] ..... H05B 41/36
(52) U.S. Cl. ..... 315/219; 315/239; 315/276
(58) Field of Search ..... 315/224, 240, 315/324, 219, 225, 287–290, 194, 94–99, 315/106, 276–279, 254, 312, 122, 119, 74, 315/244, 120, DIG. 4, 5, 239, 220, 209 R, 315/291, 307; 323/215; 363/34, 36–39

(56) References Cited

U.S. PATENT DOCUMENTS

| | | | | |
|---|---|---|---|---|
| 3,577,209 | A * | 5/1971 | Perkins | 361/264 |
| 3,631,527 | A * | 12/1971 | Splain | 315/276 |
| 3,699,385 | A * | 10/1972 | Paget | 315/239 |
| 4,009,412 | A * | 2/1977 | Latassa | 315/106 |
| 4,112,405 | A | 9/1978 | Joseph | 337/4 |
| 4,203,053 | A * | 5/1980 | Shepard | 315/254 |
| 4,435,670 | A * | 3/1984 | Evans et al. | 315/58 |
| 4,649,320 | A | 3/1987 | Hough et al. | 315/100 |
| 4,678,968 | A | 7/1987 | Lester | 315/290 |
| 4,810,936 | A | 3/1989 | Nuckolls et al. | 315/119 |
| 4,924,350 | A | 5/1990 | Reddy et al. | 361/386 |
| 4,931,701 | A * | 6/1990 | Carl | 315/239 |
| 5,053,681 | A * | 10/1991 | Budny et al. | 315/219 |
| 5,063,331 | A * | 11/1991 | Nostwick | 315/219 |
| 5,321,338 | A * | 6/1994 | Nuckolls et al. | 315/290 |
| 5,402,039 | A | 3/1995 | Wolfe | 315/119 |
| 5,463,522 | A * | 10/1995 | Van Wagener et al. | 361/103 |
| 5,604,409 | A * | 2/1997 | Fisher | 315/219 |
| 5,691,603 | A * | 11/1997 | Nilssen | 315/244 |
| 5,969,510 | A * | 10/1999 | Glasband | 323/215 |
| 6,114,816 | A * | 9/2000 | Nuckolls et al. | 315/324 |
| 6,329,767 | B1 * | 12/2001 | Sievers | 315/307 |
| 6,501,233 | B1 * | 12/2002 | Odell et al. | 315/294 |

FOREIGN PATENT DOCUMENTS

GB 2212994 A * 8/1989 ..... H02H 9/00

OTHER PUBLICATIONS

Advance, Electromagnetic Ballasts, 2001 Catalog, pp. 1-2 and 1-24.*

(Continued)

*Primary Examiner*—Wilson Lee
(74) *Attorney, Agent, or Firm*—Jansson, Shupe, Munger & Antaramian, Ltd.

(57) ABSTRACT

A ballast for electrical lighting fixtures has improved thermal protection features. The ballast has ballast laminations, primary and secondary coils, and a thermal protector, the thermal protector being wired in series with the secondary coil. When the ballast is of the type having multiple input voltage taps on the primary coil, the electrical positioning of the thermal protector in series with the secondary coil causes the wiring assembly of the thermal protector (as part of the ballast) to be independent of the primary coil input voltage tap used in a particular application. Improved electrical lighting circuits for high-intensity-discharge lamps may be obtained, the circuits having the above-described thermally-protected ballasts.

6 Claims, 7 Drawing Sheets

OTHER PUBLICATIONS

Advance, Electromagnetic Ballasts, 2001, pp. 1-2 and 1-24.*
Coaton, Lamps and Lighting, 1997, pp. 303-305.*
Advance, "Electromagnetic Ballasts," excerpts from 2001 catalog (2 pages).
LST, "Ballast Considerations," excerpts from LST's web site, dated Jul. 30, 2002 (5 pages).
Advance, "Maximized Energy Savings for 277 Volt HID Applications," date unknown (2 pages).
Advance, "Construction of a Ballast," excerpts from Advance's web site, dated Jul. 30, 2002 (7 pages).
Advance, "Regulated Lag Pulse-Start Metal Halide Ballasts," excerpts from 2001 catalog (2 pages).

* cited by examiner

THERMALLY-PROTECTED BALLAST FOR HIGH-INTENSITY-DISCHARGE LAMPS

FIELD OF THE INVENTION

This invention relates generally to ballasts with thermal protection, and more specifically to thermally-protected ballasts for lighting fixtures.

BACKGROUND OF THE INVENTION

Electrical lighting fixtures often involve the use of ballasts, and it is known practice to provide protection from overheating by including "thermal protectors" in the circuitry in order to break the flow of current to the ballasts when the thermal protector reaches a predetermined temperature. The prior art includes ballasts with either internal or external thermal protectors (i.e., internal or external with respect to the coil) positioned to interrupt the input power flowing to the primary coil of the ballast. In many prior art ballasts, thermal protectors are positioned at or near what are believed to be the most likely locations for insulation degradation, i.e., potential insulation failure points.

Ballasts for high-intensity-discharge (HID) lamps are often deemed to require thermal protection for various reasons:

In the past, a predominant reason for thermal protection of ballasts has been the possibility of insulation failures occurring within a ballast due to the expansion and contraction of the core and coil caused by the on-and-off operation over an extended period of time. Ballast overheating is related to degradation of insulation on windings due to thermal stresses. Insulation degradation can frequently develop at or near points where input voltage taps are embedded within the layers of the primary coil. Ballest manufacturers have been particularly concerned, therefore, about protecting ballasts from such aging effects.

Another known reason for providing thermal protection for a ballast is the overheating which can occur by virtue of the increased power requirements of lamps as they age, and it is this source of overheating which is the primary motivation for this invention. More specifically, as HID lamps age, two basic changes take place: One change involves the wearing (by sublimation) of the electrodes, causing the gap between the electrodes to increase slightly, raising the voltage and thereby the power required. Another change involves chemical variations and contaminations in the gaseous mixture within the lamp arc, which also tend to raise the power requirements of the lamp. Ballasts are designed to provide increasing power as demanded and, as the power rises, the steady-state temperature of the ballast also rises. In order to protect ballasts from failing catastrophically at the ends of the useful lives of certain HID lamps, it is desirable to break the flow of current at a point in time when the temperature has risen above a level deemed acceptable. These concerns are particularly important with respect to pulse-start HID lamps.

In the prior art, thermal protection issues appear to have been dealt with primarily from the ballast manufacturer's viewpoint, as described above. Thermally-protected ballasts of the prior art most typically place thermal protectors in series with the primary coil in order to interrupt the flow of power when the temperature rises above pre-set limits.

The ballast industry has developed ballasts with multiple input voltage taps on the primary coils to address the requirements for multiple voltages in HID lighting applications, thereby providing ballasts which can be adapted to a variety of HID lighting situations. (HID lighting in, e.g., the United States operates at one of several voltages, including 120V, 208V, 240V, 277V and 480V.) However, providing such flexibility in a thermally-protected ballast translates into higher assembly or installation costs for the electrical lighting manufacturer or installer, and, in both cases, creates opportunities for assembly or installation errors. Among other things, in such situations the presence of multiple input taps can be a source of costly wiring errors caused by improper placement of a thermal protector (on the wrong input line) in particular lighting applications.

There is a need for an improved thermally-protected ballast particularly suitable to protect against problems caused by end-of-life operation of HID lamps, particularly the increasingly common pulse-start HID lamps which are now frequently used in place of metal halide probe-start HID lamps of older design. While the old-style HID lamps typically reach a point where they can no longer operate and are replaced, the pulse-start HID lamps more typically will continue to operate longer and thus require higher power levels over time. Without appropriate protection, this entails greater risks of catastrophic failures.

Such need is particularly applicable to ballasts with multiple input voltage taps. There is also a need for low-cost, reliably assembled, and easily usable thermally-protected ballasts, and for devices to hold thermal protectors in place to ensure good thermal contact.

OBJECTS OF THE INVENTION

Accordingly, a principal object of this invention is to provide an improved thermally-protected ballast overcoming the problems and shortcomings described above.

Another object of this invention is to provide a thermally-protected ballast that is particularly suitable to the needs of lighting manufacturers in connection with the aging of HID lamps, particularly pulse-start HID lamps.

Another object of this invention is to provide a thermally-protected ballast with multiple input voltage taps that is assembled with its thermal protector in a manufacturing plant, independent of which primary leads of the ballast are required by the input voltage of the particular lighting application—rather than being wired during installation into a particular lighting fixture.

Yet other objects of this invention are to minimize the cost of assembly and installation of thermal protectors into ballasts for HID lighting fixtures, and to increase the reliability of assembly operations.

These and other objects of the invention will be apparent from the following descriptions and from the drawings.

SUMMARY OF THE INVENTION

The present invention is an improved thermally-protected ballast for use with HID lamps. Such improved ballast overcomes the above-noted problems and shortcomings and satisfies the objects of the invention. The ballast of this invention is of the type having ballast laminations, primary and secondary coils, and a thermal protector. In the improved thermally-protected ballast, the thermal protector is wired in series with the secondary coil.

Highly preferred embodiments of this invention are ballasts having multiple input voltage taps on the primary coil; since the electrical positioning of the thermal protector is in series with the secondary coil, wiring assembly of the thermal protector with the ballast is independent of which input voltage tap on the primary coil is used in a particular application.

In certain preferred embodiments, the thermal protector is mounted externally (not in the coil), most preferably on the ballast laminations. Most preferably, the improved ballast includes a mounting device secured to the laminations which sandwiches the thermal protector against the laminations.

This invention also involves an electrical lighting circuit for a HID lamp, such circuit using the above-described thermally-protected ballast. That is, the circuit, which includes the lamp and a ballast with ballast laminations, primary and secondary coils, and a thermal protector, has the thermal protector wired in series with the secondary coil. As noted, the ballast is preferably of the type having multiple input voltage taps on the primary coil. The lamp is preferably a pulse-start lamp.

A preferred mounting device for a thermal protector is preferably used. Such preferred mounting device is a unitary bracket which is the subject of a concurrently-filed patent application.

DETAILED DESCRIPTION OF PREFERRED EMBODIMENTS

Figure 1:
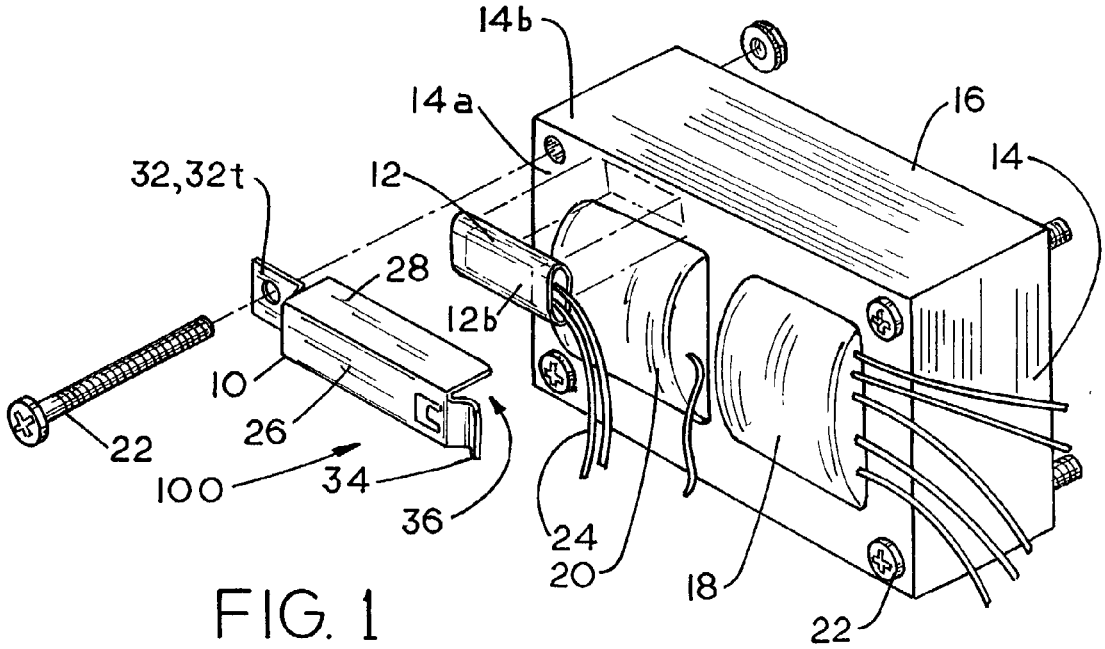
FIG. 1 is a exploded perspective view of the ballast with thermal protection in accordance with this invention.
Figure 2:
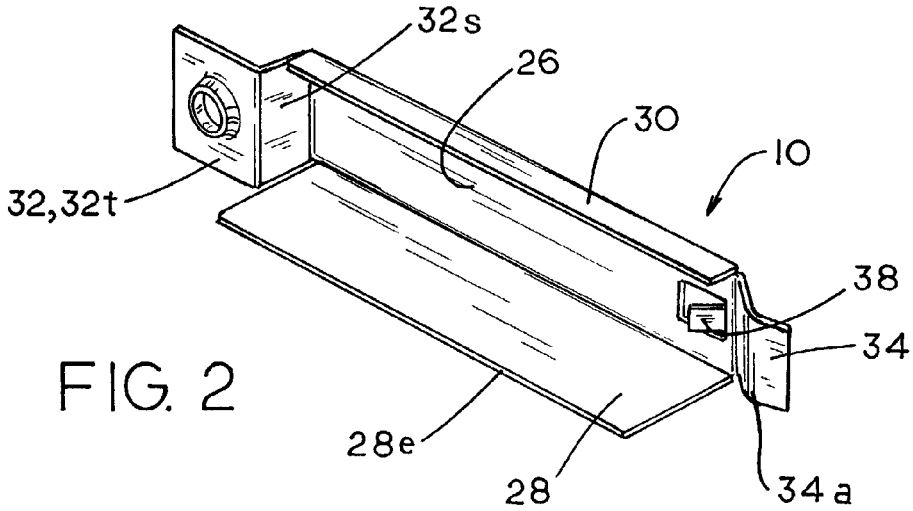
FIG. 2 is a rear inverted perspective view of the bracket of FIG. 1.
Figure 3:
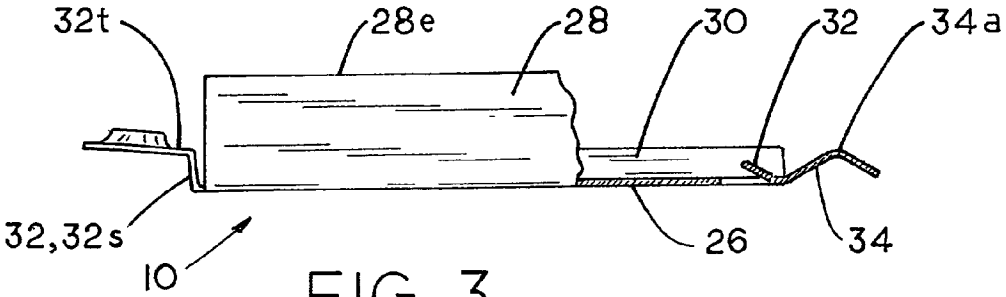
FIG. 3 is a partially broken-away top plan view of the bracket.
Figure 4:
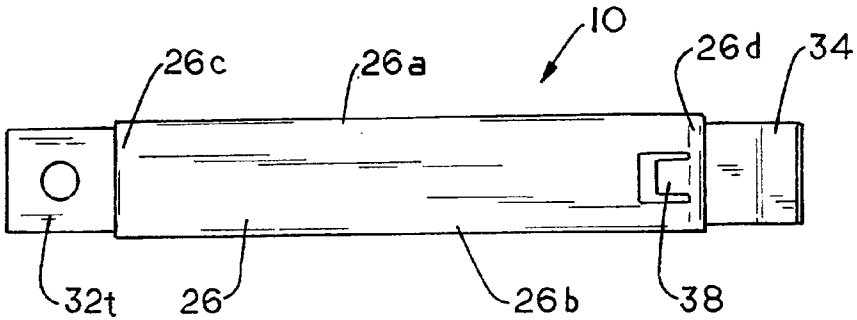
FIG. 4 is a front elevation of the bracket.
Figure 6:
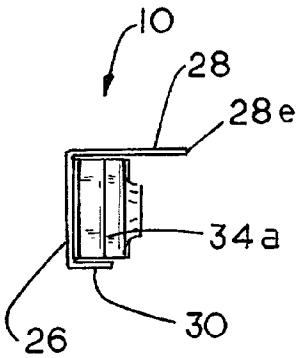
FIG. 6 is a right side elevation of the bracket.
Figure 5:
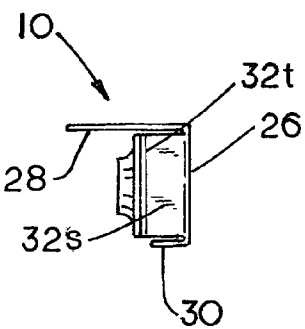
FIG. 5 is a left side elevation of the bracket.

The figures illustrate preferred embodiments of this invention. Of primary importance to this invention are FIGS. 9–12, which illustrate preferred thermally-protected ballasts, each identified by the numeral 100, as components of lighting circuits. Each lighting circuit includes an HID lamp 40, such as a pulse-start metal halide lamp. FIGS. 1-8 illustrate a preferred mounting bracket 10 and a preferred external mounting of thermal protector 12 as part of improved ballast 100.

Each preferred ballast 100 of FIGS. 9–12 has multiple voltage input taps (labeled in each case $V_1$ through $V_5$) and includes ballast laminations 16, primary and secondary coils 18 and 20, and a thermal protector 12. In each case, thermal protector 12 is wired in series with secondary coil 20.

Figure 9:
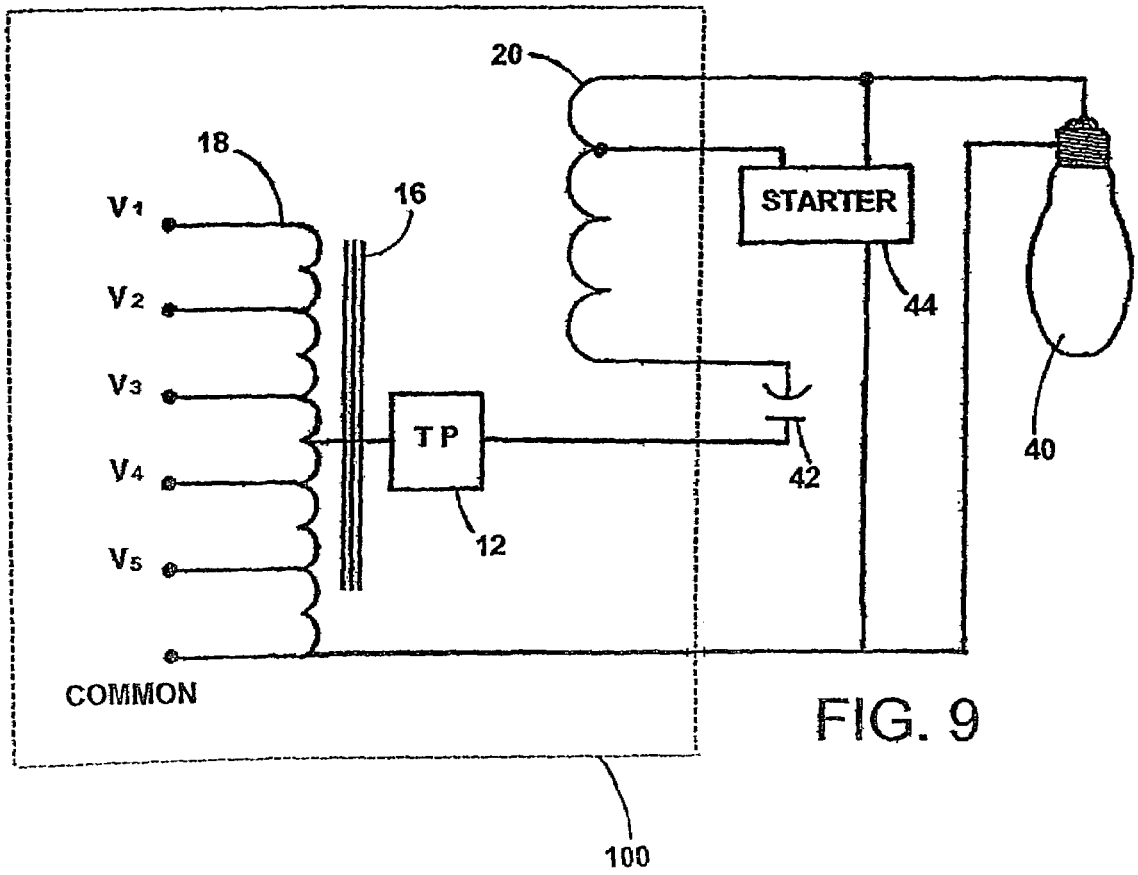
FIG. 9 is an electrical schematic of an improved thermally-protected ballast in accordance with this invention, shown as a component in a lighting circuit.
Figure 10:
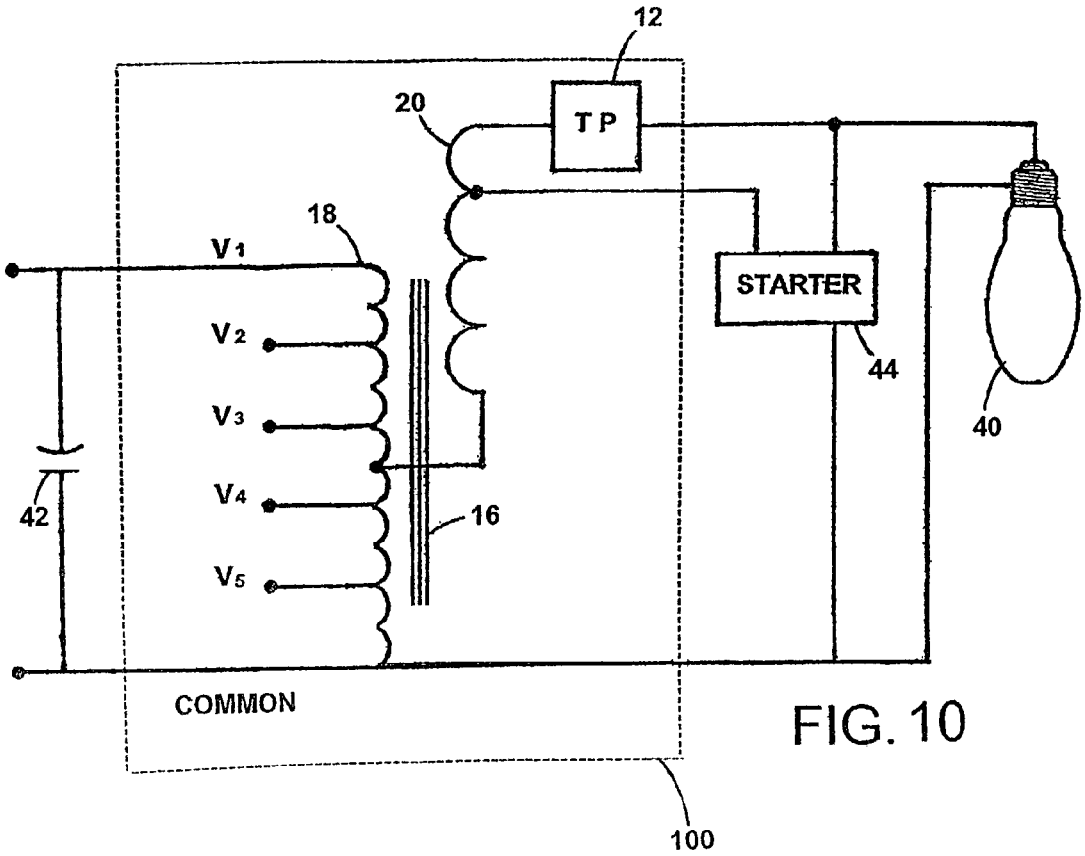
FIGS. 10–12 are electrical schematics showing other embodiments of the improved thermally-protected ballast of this invention, each as a component of a lighting circuit.
Figure 11:
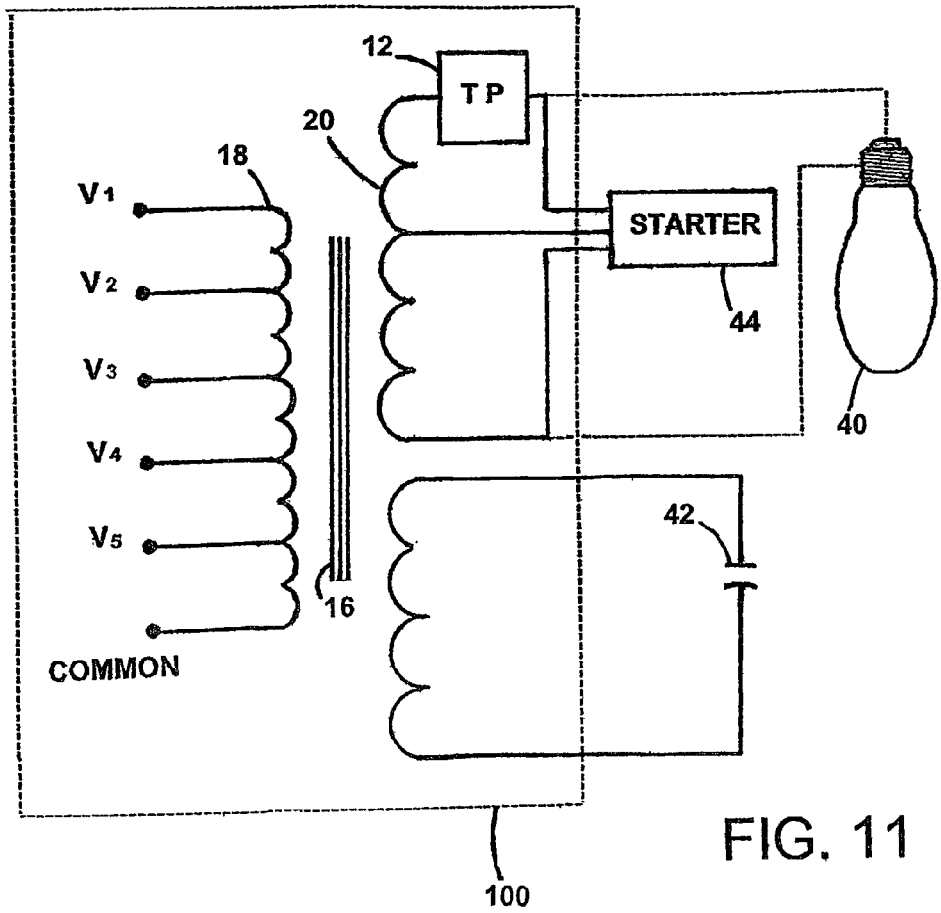
Figure 12:
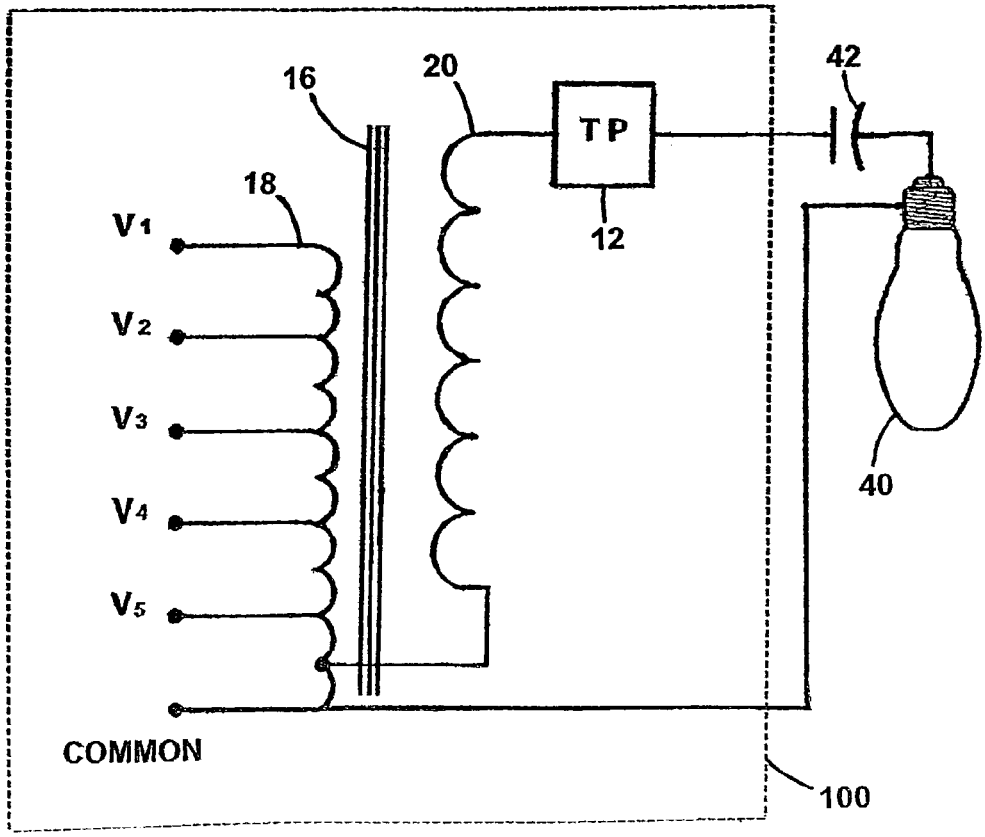

FIG. 9 shows a constant-wattage autotransformer ballast used with a pulse-start lamp; this lighting circuit includes a capacitor 42 and a starter 44. FIG. 10 illustrates a high-reactance ballast also applied in a pulse-start lamp circuit, which also includes a capacitor and starter, but in positions differing from those shown in FIG. 9. FIG. 11 shows a circuit using a regulated lag ballast, again with a pulse-start lamp, capacitor and starter in still other positions. FIG. 12 shows another circuit using a constant-wattage autotransformer ballast, and such circuit includes a capacitor.

As hereafter described, ballast 100 is in each case a modification of a non-protected ballast 14. As indicated above, wiring assembly of thermal protector 12 in series with secondary coil 20 of the ballast is independent of the input voltage to the primary coil required by the particular lamp in connection with which improved ballast 100 is used. Mechanical assembly is carried out reliably, quickly and easily at the time of manufacture.

Figure 7:
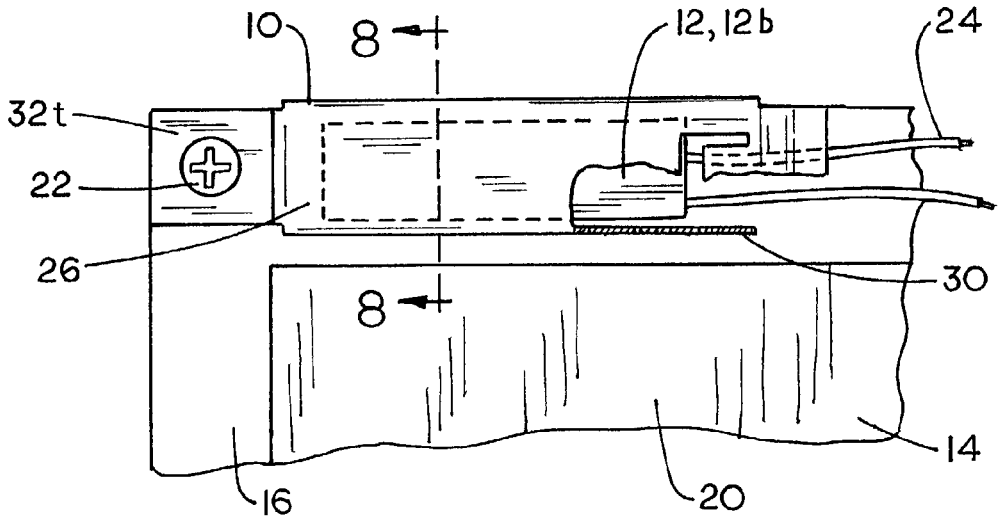
FIG. 7 is a fragmentary front elevation of the ballast with the bracket and thermal protector assembled, partially broken away to show the thermal protector.
Figure 8:
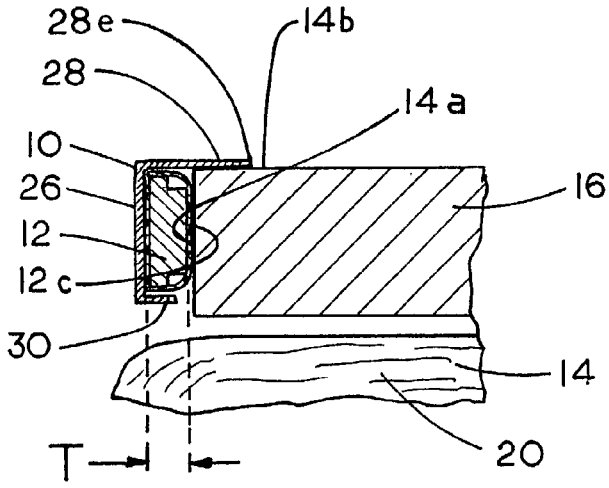
FIG. 8 is a sectional view along section 8—8 as indicated in FIG. 7.

The preferred mounting device (bracket 10) by which thermal protector 12 is integrated with ballast 14 will now be described in detail:

Bracket 10 serves the purpose of improved external mounting of thermal protector 12 to ballast 14. As already noted, ballast 14 is of the type having ballast laminations 16 and primary and secondary coils 18 and 20, respectively. Ballast bolts 22 extend through laminations 16 and assist in holding them together. One of such ballast bolts and its associated nut and lock washer serve to secure bracket 10 to ballast 14. Ballast 14 has a contact surface 14*a* (for contact with thermal protector 12) and an adjacent surface 14*b*, as shown best in FIGS. 1 and 8. FIGS. 7 and 8 illustrate bracket 10 and thermal protector 12 mechanically assembled with ballast 14, but with thermal protector wires 24 unconnected.

FIGS. 1–8 illustrate details of unitary bracket 10 and its relationship with respect to ballast 14. Unitary bracket 10 is formed of spring steel cut and bent into the desired shape, creating its various portions which will now be described. Bracket 10 includes: a holding-face portion 26, which is an unbroken planar wall that has opposite edges 26*a* and 26*b*, a mounting end 26*c* and an entry end 26*d* (see FIG. 4); first and second edge portions 28 and 30 on opposite edges 26*a* and 26*b*, respectively, of holding-face portion 26 and angled with respect to holding-face portion 26 toward ballast 14; a mounting-end portion 32 on mounting end 26*c* of holding-face portion 26 and extending toward ballast 14; and a finger-tab portion 34 on entry end 26*d* of holding-face portion 26.

Mounting-end portion 32 includes a spacing portion 32*s* which is contiguous with holding-face portion 26 and a mounting tab 32*t* which is contiguous with spacing portion 32*s* and is positioned for engagement with contact surface 14*a* of ballast 14. Bracket 10 is attached to ballast 14 by one ballast bolt 22, which firmly secures mounting tab 32*t* against contact surface 14*a*. Both mounting tab 32*t* and spacer portion 32*s* have free opposite edges, and this allows the remainder of bracket 10 to pivot slightly about mounting tab 32*t*, taking advantage of the spring qualities of the spring steel material of which bracket 10 is made. Finger-tab portion 34 extends part way toward contact surface 14*a* of ballast 14, and presents a smooth grip surface 34*a* for finger displacement of bracket 10 and for contact with wires 24 of thermal protector 12.

Thermal protector 12 has a main body 12*b* which includes a contact side 12*c* (see FIG. 8) for engagement with contact surface 14*a* of ballast 14 and a thickness dimension T (see FIG. 8) extending from contact side 12*c* to the side in contact with ballast 14. Mounting-end portion 32, particularly its spacing portion 32*s*, is configured and dimensioned such that, with thermal protector 12 removed, holding-face portion 26 is positioned no farther from contact surface 14*a* of ballast 14 than thickness T of thermal protector 12.

Indeed, with thermal protector 12 removed from bracket 10, holding-face portion 26 is in fact positioned slightly closer to contact surface 14*a* of ballast 14 than thickness T. When thermal protector 12 is in place, it is sandwiched against ballast 14 by bracket 10, acting through its holding-face portion 26. The various portions of bracket 10 are configured and dimensioned to provide such sandwiching of thermal protector 12 against ballast 14.

First and second edge portions 28 and 30 of unitary bracket 10 are parallel to one another; they are in substantially parallel planes. First edge portion 28 is wider than second edge portion 30; i.e., first edge portion 28 extends from holding-face portion 26 to a distal edge 28*e* which is spaced farther from holding-face portion 26 than thickness dimension T of thermal protector 12. As shown best in FIG. 8, first edge portion 28 extends far enough that it is in position to engage adjacent surface 14*b* of ballast 14, and in this way to serve an alignment function to properly position thermal protector 12 on contact surface 14*a* of ballast 14. Indeed, bracket 10 is configured such that the tightening of ballast bolt 22 on mounting tab 32*t* during assembly tends to rotate bracket 10 until first edge portion 28 engages adjacent surface 14*b*, where it stays as tightening of ballast bolt 22 is completed.

First and second edge portions 28 and 30 and holding-face portion 26 of unitary bracket 10 form an opening 36 (see arrow in FIG. 1) for insertion of thermal protector 12 and from which its wires 24 extend. Insertion of thermal protector 12 during assembly and any later replacement thereof are carried out easily and accurately by simply flexing the non-attached end of bracket 10, i.e., the end where finger-tab portion 34 is located, slightly away from ballast 14—enough to allow insertion. Bracket 10 also includes a retention spur 38 (see FIGS. 2–4), which is bent inwardly from holding-face portion 26 in a position near opening 36 which is beyond the end of main body 12*b* (of thermal protector 12) from which wires 24 project. Retention spur 38 projects from holding-face portion 26 in position to engage main body 12*b* of thermal protector 12 in order to prevent unintended withdrawal of thermal protector 12.

In the circuit illustrated in FIG. 9, lamp 40 is an M132 ANSI Code 320 W metal halide lamp, and capacitor 42, starter 44, and ballast 14 from which improved ballast 100 is made all are specified in accordance with the M132 ANSI Code 320 rating of the lamp. Thermal protector 12 of improved ballast 100 is a Texas Instruments Series 7AM thermal protector designed to open at a temperature of 150° C. with a current rating in accordance with the lamp specified above, such thermal protector being placed in series with the secondary coil of the ballast. Thermal protector 12 as used in the preferred embodiment includes, on its outside, an electrically-insulating Mylar sleeve.

Appropriate materials and parts for the devices of this invention will be apparent to those who are skilled in the art and are made aware of this invention. Also, a great many substantial variations are possible in the configurations of unitary brackets designed to include the characteristics and requirements of this invention; variations in size, shapes and materials for the inventive bracket are possible. Likewise, substantial variations are possible in ballasts with thermal protection which include the inventive characteristics described and claimed herein.

While the principles of the invention have been shown and described in connection with specific embodiments, it is to be understood that such embodiments are by way of example and are not limiting.

What is claimed is:

1. Apparatus comprising:

a single-phase ballast for high-intensity discharge (HID) lighting fixtures, the ballast having ballast laminations, a primary coil and a secondary coil, the primary coil having multiple input voltage taps; and a thermal protector structured for breaking a current flow when the thermal protector reaches a predetermined temperature, the thermal protector being wired in series with the secondary coil.

2. Apparatus comprising:

a single-phase ballast for high-intensity discharge (HID) lighting fixtures, the ballast having ballast laminations, a primary coil and a secondary coil, and a pulse-start circuit; and a thermal protector structured for breaking a current flow when the thermal protector reaches a predetermined temperature, the thermal protector being wired in series with the secondary coil.

3. Apparatus comprising:

a single-phase ballast for high-intensity discharge (HID) lighting fixtures, the ballast having ballast laminations, a primary coil and a secondary coil, the ballast having an autotransformer configuration for the primary and secondary coils; and a thermal protector structured for breaking a current flow when the thermal protector reaches a predetermined temperature, the thermal protector being wired in series with the secondary coil.

4. Apparatus comprising:

a single-phase ballast for high-intensity discharge (HID) lighting fixtures, the ballast having ballast laminations, a primary coil and a secondary coil;

a thermal protector structured for breaking a current flow when the thermal protector reaches a predetermined temperature, the thermal protector being wired in series with the secondary coil; and a starter in parallel with the secondary coil.

5. Apparatus comprising:

a single-phase ballast for high-intensity discharge (HID) lighting fixtures, the ballast having ballast laminations, a primary coil and a secondary coil;

a thermal protector structured for breaking a current flow when the thermal protector reaches a predetermined temperature, the thermal protector being wired in series with the secondary coil; and a high-intensity-discharge (HID) lamp in parallel with the secondary coil.

6. A method comprising:

providing a single-phase ballast for high-intensity-discharge (HID) lighting fixtures, the ballast having ballast laminations, a primary coil and a secondary coil;

providing a thermal protector structured for breaking a current flow when the thermal protector reaches a predetermined temperature, the thermal protector being wired in series with the secondary coil; and providing a starter in parallel with the secondary coil.

* * * * *